United States Patent [19]

Oyama

[11] Patent Number: 4,741,404

[45] Date of Patent: May 3, 1988

[54] PERCUSSION TOOL UTILIZING NEGATIVE PRESSURE

[75] Inventor: Nobuo Oyama, Choufu, Japan

[73] Assignee: Landmark West Ltd., Tokyo, Japan

[21] Appl. No.: 772,596

[22] Filed: Sep. 4, 1985

[30] Foreign Application Priority Data

Nov. 2, 1984 [JP] Japan ..... 59-230311

[51] Int. Cl.[4] ..... B25D 9/16

[52] U.S. Cl. ..... 173/17; 173/134

[58] Field of Search ..... 173/17, 60, 90, 91, 173/126, 127, 133, 134–138, 125, 162, 119, 121; 92/134; 91/6, 394; 60/411

[56] References Cited

U.S. PATENT DOCUMENTS 3,299,968 1/1967 Cunningham ..... 173/138

4,100,976 7/1978 Stone ..... 173/133

*Primary Examiner*—E. R. Kazenske

*Assistant Examiner*—James L. Wolfe

*Attorney, Agent, or Firm*—Jordan and Hamburg

[57] ABSTRACT

A percussion tool has a frame in which a percussion element is fitted such that it can move axially by a small distance and in which a hammer for hitting the percussion element is supported axially movably. The hammer is moved toward a standby position by a supply of a high pressure thereto, while forming a negative pressure acting on the hammer to force it toward a percussion position and, in the standby position, the high pressure is released to allow the hammer to move toward the percussion position by the negative pressure.

4 Claims, 2 Drawing Sheets

PERCUSSION TOOL UTILIZING NEGATIVE PRESSURE

BACKGROUND OF THE INVENTION

The present invention relates to a percussion tool which has a percussion element and a hammer which is reciprocated between a percussion position for hitting the percussion element and a standby position so that an object is broken by the percussion element repeatingly hit by the reciprocating hammer.

Such percussion tool is used to break an asphalt paving in repairing a pavement or to break walls of a building for repair or reconstruction thereof. In such application, a top point of a percussion element of the tool, i.e., chisel, abuts an object to be broken and, in such state of the chisel, it is hit by the hammer repeatingly to push the chisel into the object gradually to thereby crack the object.

In the conventional percussion tool in which the hammer in the standby position is moved toward the percussion position by supplying a pressurized fluid such as air, there are considerable vibrations produced due to mainly reactive forces of the supplied air during the movement of the hammer toward the percussion position.

There are also considerable vibrations produced immediately after the hammer hits the chisel. These vibrations are produced due to the fact that the chisel is generally mounted through a resilient means such as springs on a frame of the tool and there are reactive forces produced in these springs immediately after the hammer hits the chisel.

It has been known that, among these vibrations, the vibrations produced immediately after the hitting by the hammer can be minimized by supporting the chisel axially slidably. However, the problem of vibrations due to the reaction forces of the compressed air etc., have been left as they are. In using the percussion tool having the chisel and the hammer, the tool is usually hand held. However, since the conventional percussion tool produces considerable vibrations as above mentioned, it is impossible to use if for a prolonged time period.

The percussion tool may be supported by a suitable machine, e.g., a backhoe. Even in such case, the machine must be large enough to withstand the vibrations, which is disadvantageous in view of economy.

SUMMARY OF THE INVENTION

An object of the present invention is to provide a percussion tool in which the vibration problem inherent to the conventional percussion tool is substantially eliminated.

The above object can be achieved, according to the present invention, by a provision of a percussion tool having a percussion element and a hammer adapted to hit the percussion element by a reciprocal movement thereof between a percussion position in which it hits the percussion element and a standby position to thereby break an object, comprising a frame for supporting at an end thereof the percussion element, a low pressure chamber defined by a rear end of the percussion element, an inner wall of said frame and a front end of the hammer when the latter is moved toward the standby position, a high pressure chamber defined by said inner wall of said frame and an outer surface of the hammer and adapted to be supplied with a high pressure fluid for moving the hammer toward the standby position, a middle pressure chamber defined by said inner wall of said frame and a rear end of the hammer and a pressure reducing means for reducing a force applied to the hammer due to a high pressure of said high pressure chamber to a value at least equal to a force applied to the hammer due to a pressure of said middle pressure chamber and larger than a force applied to the hammer due to a pressure of said low pressure chamber when the hammer reaches the standby position, whereby the hammer is moved toward the percussion position by a difference in pressure between said middle pressure chamber and said low pressure chamber.

Thus, according to the present invention, there is no need of using a high pressure fluid to provide the movement of the hammer toward the percussion position and, therefore, the vibrations produced during the hitting movement of the hammer due to the reactive forces of the high pressure fluid can be minimized, resulting in that a substantially vibrationless operation of the percussion tool is realized.

DETAILED DESCRIPTION OF THE PREFERRED EMBODIMENT

Figure 1:
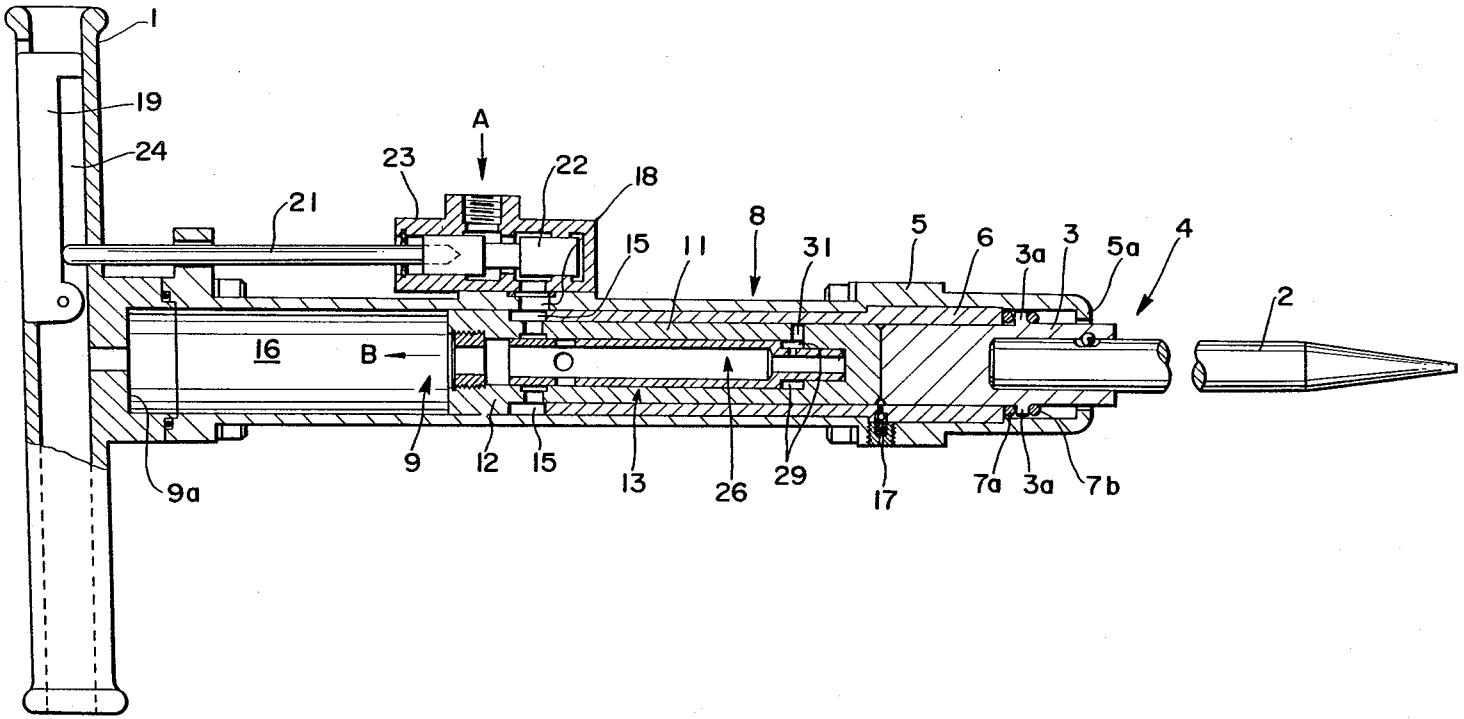
FIG. 1 is a cross sectional side view of an embodiment of the present invention.

Referring to FIG. 1, there is shown, in a cross sectional side view, a percussion tool of the hand-held type embodying the present invention.

The percussion tool is supported at a handle, thereof by hands such that a top point of a chisel 2 is pressed to an object (not shown) to be broken and is operated to apply a percussion force to the object.

A rear end portion of the chisel 2 is supported by an anvil 3 which forms, together with the chisel 2, a percussion element 4. The anvil 3 is slidably fitted in a bushing 6 which is fixedly fitted in a casing 5. A sliding movement of the anvil 3 in the bushing 6 is limited substantially by abuttments of an annular flange 3*a* formed on the anvil 3 to a front end of the bushing 6 and a shrunken front end 5*a* of the casing 5, that is, the anvil 3 can move along the casing 5 within a distance defined substantially between the front end of the bushing 6 and the front end 5*a* of the casing 5. In both sides of the annular flange 3*a* of the anvil 3, O-rings 7*a* and 7*b* of a shock-absorbing material such as rubber are arranged, respectively, as shown.

The casing 5 and the bushing 6 fixedly fitted in the casing 5 constitute a frame 8 in which a cylindrical space 9 is formed. In the space 9, a piston or hammer 13 is slidably disposed.

The hammer 13 is shouldered to form a reduced diameter portion 11 which is slidably fitted in the bushing 6 and a large diameter portion 12 which is slidably fitted in the casing 5. The hammer 13 can slide in the space within a range between a percussion position (FIG. 1) in which a front end thereof contacts with the rear end of the anvil 3 and a standby position (FIG. 3) in which the distance between a rear end 13*a* of the hammer 13 and a rear end 9*a* of the space 9 becomes minimum. Within this range, the reduced diameter portion 11 of the hammer 13 slides in and along the bushing 6 and the portion 12 thereof slides along an inner surface of the casing 5.

Figure 2:
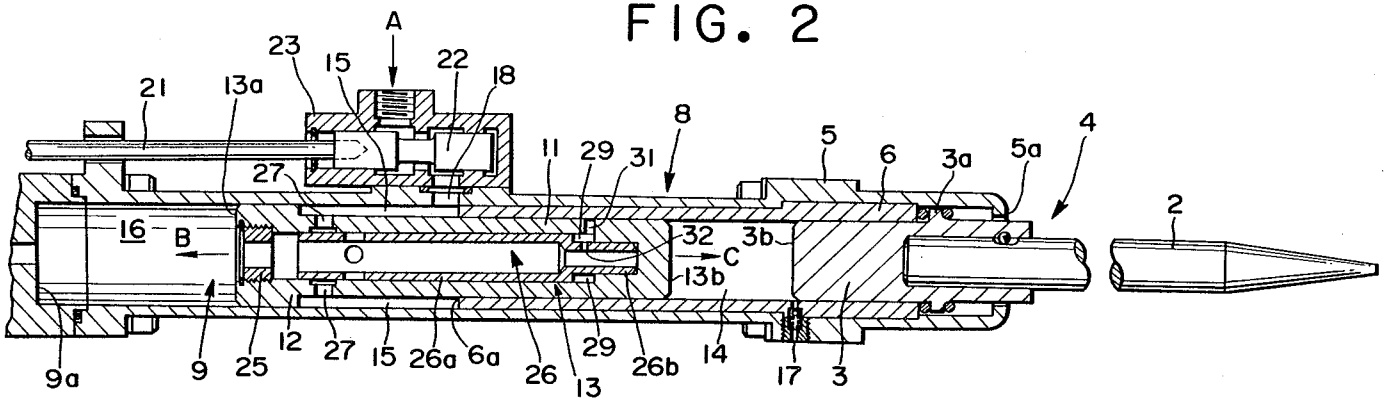
FIG. 2 is a similar view to FIG. 1, showing a hammer on a way of its stroke.

FIG. 2 shows the hammer 13 in a middle position of its stroke. In this state, the space 9 is divided into three chambers, a low pressure chamber 14 defined by the front end 13*b* of the hammer 13, the inner wall of the bushing 6 and the rear end 3*b* of the anvil 3, a high pressure chamber 15 defined by the rear end 6*a* of the bushing 6, the inner wall of the casing 5 and the shouldered portion 12 of the hammer 13 and a middle pressure chamber 16 formed rearwardly of the hammer 13.

Figure 3:
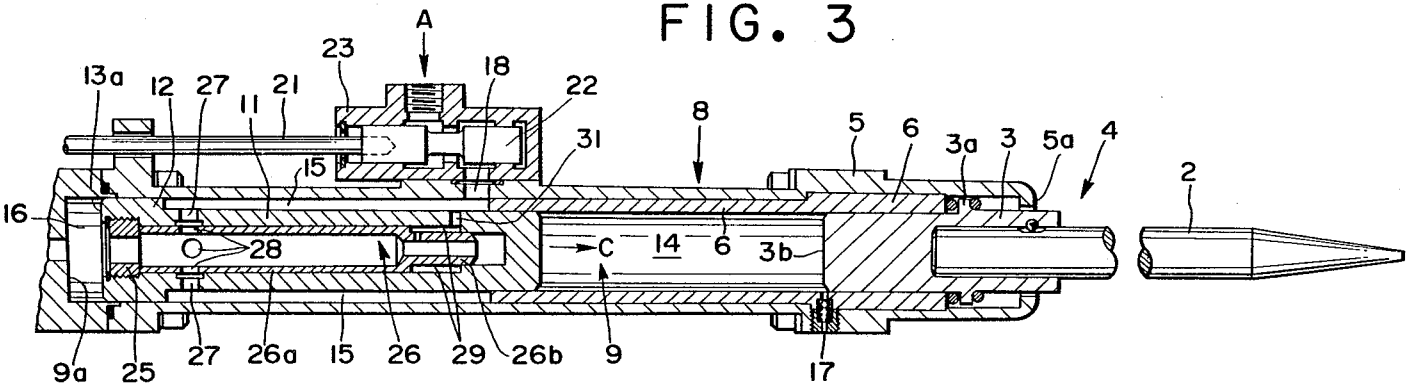
FIG. 3 is a similar view to FIG. 1, showing the hammer in the standby position.

The volume of the low pressure chamber 14 increases with a sliding movement of the hammer 13 toward the standby position (FIG. 3).

The contacts between the anvil 3 and the inner wall of the bushing 6 and between the reduced diameter portion 11 of the hammer 13 and the inner wall of the bushing 6 are kept fluid-tight and, therefore, the low pressure chamber 14 is maintained at a substantially reduced pressure.

An one-way valve 17 is provided in a laminated portion of the bushing 6 and the casing 5 in the vicinity of the rear end of the anvil 3 so that a fluid such as air in the lower pressure chamber 14 can be released therethrough, if necessary, while a fluid flow in a reverse direction is prevented.

The volume of the high pressure chamber 15 is also increased with the sliding movement of the hammer 13 toward the standby position.

A radial air supply port 18 is formed in the casing 5 in the vicinity of the rear end of the bushing 6, to which a valve 23 is connected. The valve 23 includes a valve body 22 fixedly secured through a connecting rod 21 to a lever member 19 which is pivotally supported by the handle 1 as shown in FIG. 1.

A fluid A such as pressurized air can be fed to the port 18, according to a proper regulation of the valve body 22, to increase the pressure in the high pressure chamber 15.

On the other hand, the volume of the middle pressure chamber 16 reduces with the movement of the hammer 13 toward the standby position. As shown in FIG. 1, the middle pressure chamber 16 is opened to atmosphere through a hole 24, so that, when the hammer 13 is moved toward the standby position, air in the middle pressure chamber 16 can be released.

The hammer 13 is formed with an axially extending blind hole opened at the rear end thereof to the middle pressure chamber 16. The blind hole is shouldered is the vicinity of a closed end thereof, that is, the diameter of the blind hole is reduced in the vicinity of the closed end thereof.

The open end of the blind hole is threaded so that and end cap 25 having a center hole can be screwed in. In the blind hole, a valve body 26 in the form of a generally cylindrical hollow tube is slidably fitted. The valve body 26 has a main portion 26*a* which slidingly fits in the large diameter portion of the blind hole and a reduced diameter portion 26*b* which fits in the reduced diameter portion of the blind hole. The length of the reduced diameter portion 26*b* is slightly larger than the length of the reduced diameter portion of the blind hole. The valve body 26 is able to axially slide within a distance between a closed position (FIG. 1, 2) in which a front end of the reduced diameter portion 26*b* thereof contacts with the closed end of the blind hole and an open position (FIG. 3) in which a rear end of the portion 26*b* thereof contacts the cap 25.

The valve body 26 closes an air port 27 provided in the reduced diameter portion 11 of the hammer 13 in the vicinity of the shoulder thereof formed between the portion 11 and the large diameter portion 12 thereof when it reaches the close position. When the valve body 26 is in the open position, a port 28 formed in the main portion 26*a* thereof comes into communication with the air port 27 (FIG. 3), as a result of which the pressure of the high pressure chamber 15 is released through the ports 27 and 28 to the middle pressure chamber 16 and hence to the atmosphere.

Due to the difference in length between the reduced diameter portion 26*b* of the valve body 26 and the reduced diameter portion of the blind hole of the hammer 13, a small annular pressure regulation chamber 29 is formed around the reduced diameter portion 26*b* of the valve body 26. The annular pressure regulation chamber 29 is capable of being opened outwardly through a port 31 formed in a side wall of the hammer 13 in the vicinity of the stepped portion of the large diameter portion of the blind hole thereof. The annular space 29 also communicates through a port 32 formed in a wall of the reduced diameter portions 26*b* of the valve body 26 in the vicinity of the shoulder thereof with the interior of the valve body 26.

In operation, when the chisel 2 abuts the object to be broken and assuming that the hammer 13 is in the percussion position, the anvil 3 is pushed in until the annular flange 3*a* thereof contacts with the front end of the bushing 6. This state is shown in FIG. 1. In this state, when the lever member 19 is swung to the illustrated position by grasping the handle 1 of the percussion tool, the compressed air A is supplied through the port 18 to the high pressure chamber 15, causing the inner pressure of the latter chamber to be increased.

With the increased pressure of the high pressure chamber 15, the shoulder portion of the hammer 13 is moved toward the standby position as shown by an arrow B. During this movement of the hammer 13, the pressure of the low pressure chamber 14 becomes negative the degree of which increases until the port 31 thereof enters into an area of the high pressure chamber 15.

When the port 31 of the hammer 13 communicates with the high pressure chamber 15 as shown in FIG. 3, the high pressure air in the chamber 15 flows into the pressure regulation chamber 29 to thereby increase the pressure therein. Therefore, the valve body 26 is pushed thereby rearwardly, as a result of which the high pressure chamber 15 is opened through the port 27 of the hammer 13 and the port 28 of the valve body 26 to the middle pressure chamber 16 which has been opened to atomosphere.

Thus, the pressure of the high pressure chamber 15 is reduced to atmospheric pressure.

At this time, since the pressure of the low pressure chamber 14 is highly negative as mentioned previously, the moving direction of the hammer 13 is reversed, by a pressure difference between the middle pressure chamber 16 and the low pressure chamber 14 and thus the hammer 13 is moved toward the percussion position as shown by an arrow C in FIG. 3.

When the hammer 13 reaches the percussion position, it hits the anvil 3 and hence the chisel 2 to force the latter to the object to thereby break the same.

As is clear from the foregoing, according to the present invention, the hammer is forced from the standby position to the percussion position not by a high pressure supplied rearwardly of the hammer as in the conventional percussion tool but a negative pressure produced in the space between the front end of the hammer and the rear end of the anvil as a result of the preceding movement of the hammer to the standby position. Therefore, the problem inherent to the conventional percussion tool, i.e., the vibrations due to the reactive forces produced by the supply of high pressure fluid to the hammer to cause the movement thereof toward the percussion position can be eliminated.

There might be a case where the vacuum degree of the low pressure chamber 14 is not enough to effectively hammer the anvil 3 with the hammer 13. That is, when any residual air in the low pressure chamber 14 might produce a braking force acting on the hammer moving to the percussion position. In order to eliminate such undesirable effect of residual air in the low pressure chamber 14, the one-way valve 17 acts to release such residual air after the hammer 13 is given an enough amount of inertia.

It should be noted that, although, in the above described embodiment, the valve 26 provided in the hammer 13 and the port 27 formed in the wall thereof are used as a pressure reducing means for reducing the pressure in the high pressure chamber 15 to start and complete the percussion mode stroke of the hammer, it may take any other form so long as it can reduce the force to be applied to the hammer 13 by the high pressure of the high pressure chamber to a value equal to or smaller than the force to be applied thereto by the atmospheric pressure in the middle pressure chamber 16 and larger than the force applied to the hammer by the pressure of the low pressure chamber 14.

What is claimed is:

1. A percussion tool having a percussion element and a hammer movable between a percussion position and a standby position away from said percussion element, comprising;

a frame;

a fluid tight low pressure chamber within said frame between said percussion element and hammer;

a high pressure chamber within said frame, said hammer being mounted to be responsive to high pressure in said high pressure chamber to move to said standby position;

an intermediate pressure chamber; and a pressure reducing means for venting said high pressure chamber to said intermediate chamber when said hammer is moved to said standby position;

said pressure reducing means comprising;

a valve slidably fitting in a bore of the hammer;

first and second air ports positioned in the hammer for cooperating with said high pressure chamber;

an annular pressure regulation chamber in said hammer open to said second of said air ports;

a longitudinal bore in the valve, said bore having a third air port opening to said regulation chamber and a fourth air port, said bore opening to the intermediate pressure chamber;

whereby the pressure in said low pressure chamber is reduced by movement of said hammer to said standby position and the hammer is attracted to move toward the percussion position by the reduced pressure in the low pressure chamber when the hammer reaches the standby position, when the hammer is in the standby position, a high pressure fluid in the high pressure chamber flowing through the second air port into the annular pressure regulation chamber to move the valve in a direction away from th percussion element, and when the valve is in the furthermost position of the hammer away from the percussion element, the high pressure fluid in the high pressure chamber flowing through the first and fourth air ports and said longitudinal bore into the intermediate pressure chamber to reduce the pressure of the high pressure chamber.

2. The percussion tool of claim 1 wherein said intermediate pressure chamber is open to the atmosphere.

3. The percussion tool of claim 1 further comprising a one way valve in the low pressure chamber for venting pressure to the atmosphere that is greater than atmospheric pressure.

4. The percussion tool of claim 1, wherein said intermediate pressure chamber is open to the atmosphere.

* * * * *